US006308019B1

(12) United States Patent
Miyashiro et al.

(10) Patent No.: US 6,308,019 B1
(45) Date of Patent: Oct. 23, 2001

(54) IMAGE FORMING APPARATUS HAVING DIFFERENT OPERATING VALUES FOR FIRST AND SECOND SIDE IMAGE FORMATION

(75) Inventors: Toshiaki Miyashiro, Shizuoka-ken; Takaaki Tsuruya, Mishima, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/392,302

(22) Filed: Sep. 8, 1999

(30) Foreign Application Priority Data

Sep. 12, 1998 (JP) ..... 10-276583

(51) Int. Cl.[7] ..... G03G 15/16

(52) U.S. Cl. ..... 399/66; 399/101; 399/297; 399/302; 399/309

(58) Field of Search ..... 399/66, 101, 297–299, 399/302, 309

(56) References Cited

U.S. PATENT DOCUMENTS 5,678,130 10/1997 Enomoto et al. ..... 399/55
5,732,310 * 3/1998 Hiroshima et al. ..... 399/101
5,809,373 * 9/1998 Yoda et al. ..... 399/101
5,809,387 9/1998 Takeuchi et al. ..... 399/302
5,999,763 * 12/1999 Hiroshima et al. ..... 399/66
6,049,681 * 4/2000 Shiozawa et al. ..... 399/66 X
6,094,557 * 7/2000 Shinohara ..... 399/302

* cited by examiner

*Primary Examiner*—William J. Royer
(74) *Attorney, Agent, or Firm*—Fitzpatrick, Cella, Harper & Scinto

(57) ABSTRACT

An image forming apparatus includes an intermediate transfer member, an image forming device for forming a toner image on the intermediate transfer member, a charging device for charging residual toner remaining on the intermediate transfer member after the toner image formed by the image forming device and located on the intermediate transfer member is electrostatically transferred onto a transfer material. The residual toner charged by the charging device and remaining on the intermediate transfer member is electrostatically transferred onto the image forming device. After the toner image is transferred from the intermediate transfer member to a first side of the transfer material, a toner image can be transferred from the intermediate transfer member to a second side of the transfer material opposite to the first side, and a control device for controlling voltage to be impressed to the charging device in dependence upon whether the toner image was transferred from the intermediate transfer member to the first side of the transfer material or the toner image was transferred from the intermediate transfer member to the second side of the transfer material.

55 Claims, 10 Drawing Sheets

IMAGE FORMING APPARATUS HAVING DIFFERENT OPERATING VALUES FOR FIRST AND SECOND SIDE IMAGE FORMATION

BACKGROUND OF THE INVENTION

1. Field of the Invention

The present invention relates to an image forming apparatus such as a copying machine, a printer, a facsimile and the like, and more particularly, it relates to an image forming apparatus in which an image on an image bearing member is transferred onto an intermediate transfer member and then the image on the intermediate transfer member is transferred onto a transfer material.

2. Related Background Art

FIG. 9 shows an example of a conventional color image forming apparatus. In FIG. 9, a photosensitive drum (image bearing member) 104 is rotated by driving means (not shown) in a direction shown by the arrow and is uniformly charged by a primary charger 105. Then, a laser beam corresponding to a magenta image pattern is illuminated onto the photosensitive drum 104 from an exposure device 110 to form a latent image on the photosensitive drum 104. When the photosensitive drum 104 is further rotated in the direction shown by the arrow, among developing devices 107*a*, 107*b*, 107*c*, 107*d* supported by a rotary supporting member 107*e*, a magenta developing device 107*a* containing magenta toner is rotated to be opposed to the photosensitive drum 104, so that the latent image is visualized by the magenta developing device 107*a* as a toner image.

An intermediate transfer belt (intermediate transfer member) 103 is passed over on three rollers 121, 122, 123 and is rotated at a speed substantially the same as that of the photosensitive drum 104 in a direction shown by the arrow. By impressing primary transfer bias to a primary transfer roller 102, the toner image formed on the photosensitive drum 104 is primary-transferred onto an outer peripheral surface of the intermediate transfer belt 103.

By repeating the above-mentioned process with respect to a cyan color, an yellow color and a black color by using the developing devices 107*b*, 107*c*, 107*d*, respectively, plural color toner images are formed on the intermediate transfer belt 103.

Then, a transfer material 113 is fed from a transfer material cassette 113*a* by a pick-up roller 112 at a predetermined timing. At the same time, secondary transfer bias is impressed to a secondary transfer roller 108, with the result that the toner images on the intermediate transfer belt 103 are transferred onto the transfer material 113 collectively. Then, the transfer material 113 is conveyed, by a conveying belt 120, to a fixing device 109, where the toner images are fused and fixed, thereby obtaining a color image.

After the secondary transfer, residual toner remaining on the intermediate transfer belt 103 is charged with opposite polarity by a charging device 101*a* as an intermediate transfer belt cleaning device 101, with the result that the residual toner is counter-transferred onto the photosensitive drum 104, thereby cleaning or removing the residual toner. On the other hand, residual toner after primary transfer and counter-transfer toner on the photosensitive drum 104 are removed by a photosensitive drum cleaning device 106.

Now, the cleaning of the intermediate transfer belt will be fully described.

Residual toner after secondary transfer is subjected to a strong electric field having polarity opposite to that of the toner when the toner is transferred from the intermediate transfer belt 103 to the transfer material 113, with the result that the residual toner may remain on the intermediate transfer belt 103 in a condition that the residual toner has been charged with polarity (positive polarity in this conventional case) opposite to normal charging polarity (negative polarity in this conventional case) of the toner. However, all toners cannot be reversed to the positive polarity, but there are toners partially neutralized not to have charges and/or toners remaining in negative polarity.

Thus, the charging device 101*a* is disposed at a downstream side of a secondary transfer position, i.e., immediately behind the secondary transfer position in a moving direction of the intermediate transfer belt 103 so that bias obtained by superposing an AC component with a DC component is impressed as a intermediate transfer belt cleaning bias by the charging device 101*a*. The residual toner after secondary transfer is reciprocally moved by the AC component repeatedly so that the toner is charged more uniformly with positive polarity.

The uniformly and positively charged residual toner after secondary transfer is counter-transferred onto the photosensitive drum 104 at a primary transfer nip portion and then is collected by the cleaning device 106 from the photosensitive drum 104.

In a print operation in which a plurality of transfer materials are continuously printed, the charges of the oppositely charged residual toner after secondary transfer on the intermediate transfer belt 103 and the charges of the normal toner (to be primary-transferred) on the photosensitive drum 104 do not cancel each other by short time contact therebetween. Thus, at the primary transfer nip portion between the photosensitive drum 104 and the intermediate transfer belt 103, when the primary transfer bias is impressed, the residual toner after secondary transfer and the toner on the photosensitive drum 104 can be substantially simultaneously transferred onto the photosensitive drum 104 and the intermediate transfer belt 103, respectively. Accordingly, since the residual toner after secondary transfer is not transferred onto the transfer material 113 in the next print, a proper image can be outputted.

When the above-mentioned intermediate transfer belt cleaning device 101 is used, a waste toner container for collecting the residual toner on the intermediate transfer belt 103 can also serve as the photosensitive drum cleaning device 106 so that the apparatus can be made compact and a maintenance ability can be improved.

By the way, in color image forming apparatuses such as the above-mentioned conventional color image forming apparatus, recently, an automatic both-side printing function has frequently been added. As shown in FIG. 10, the automatic both-side printing function is realized by optionally adding a both-side unit 130 to the conventional image forming apparatus externally or internally.

In the image forming apparatus having the automatic both-side printing function, there is provided selecting means 111 for selecting between a conveying path for discharging a sheet and a conveying path communicating with the both-side unit 130, in dependence upon whether the transfer material 113 discharged from the fixing device 109 relates to a first side print or a second side print. Further, the transfer material 113 conveyed to the both-side unit 130 by the selecting means 111 remains within the both-side unit 130 until an image to be printed in the second-side print is prepared on the photosensitive drum 104, and is re-fed in sync with a second-side image formation.

Several (1 to 3) transfer materials 113 can be stocked within the both-side unit 130 and the transfer material 113 is re-fed in response to a signal from control means (not shown) capable of judging a property of the image (whether a first-side image or a second-side image).

In the both-side print as mentioned above, since electric properties (resistance value, change in electrostatic capacity due to partial adhesion of toner layer and the like) and mechanical properties (rigidity of transfer material, curling condition and the like) of the transfer material to which the first-side image was transferred and fixed are changed, a second-side transferring condition will differ from the first-side transferring condition greatly. As a result, second-side image quality may considerably be worsened in comparison with first-side image quality.

To improve this, there has been proposed a technique in which the second-side image quality is improved by changing the transfer bias in the second-side transferring.

However, in the image forming apparatus using the intermediate transfer member cleaning device 101 as mentioned in connection with the above conventional technique, when the cleaning of the intermediate transfer belt is effected, the cleaning permitting conditions are that the residual toner after secondary transfer remains on the intermediate transfer belt 103 as little as possible and almost all of the toner has positive polarity. Therefore, even when the second-side transferring ability is enhanced, if an amount of the residual toner after secondary transfer having negative polarity is great, the residual toner after secondary transfer cannot be charged uniformly by the charging device 101*a,* with the result that the subsequent counter-transferring process at the primary transfer position becomes incomplete, thereby affecting a bad influence of intermediate belt cleaning failure upon the next image.

Particularly, in case of full-color image formation, even for the first-side print, the transferring condition for uniformly secondary-transferring all of the components from a monochromatic half-tone image to four color superposed images without poor image due to abnormal electric discharging is very severe, and, in the second-side print in which the transferring condition becomes more severe, an area where the residual toner after secondary transfer having negative polarity exists is generated on the same image without fail, thereby causing the intermediate transfer belt cleaning failure.

SUMMARY OF THE INVENTION

Accordingly, an object of the present invention is to provide an image forming apparatus in which, even when images are formed on both sides of a transfer material, a poor cleaning of an intermediate transfer member can be prevented.

The other objects and features of the present invention will be apparent from the following detailed explanation of the invention.

DESCRIPTION OF THE PREFERRED EMBODIMENTS

Now, an image forming apparatus according to the present invention will be fully explained with reference to the accompanying drawings.

[First Embodiment]

Figure 9:
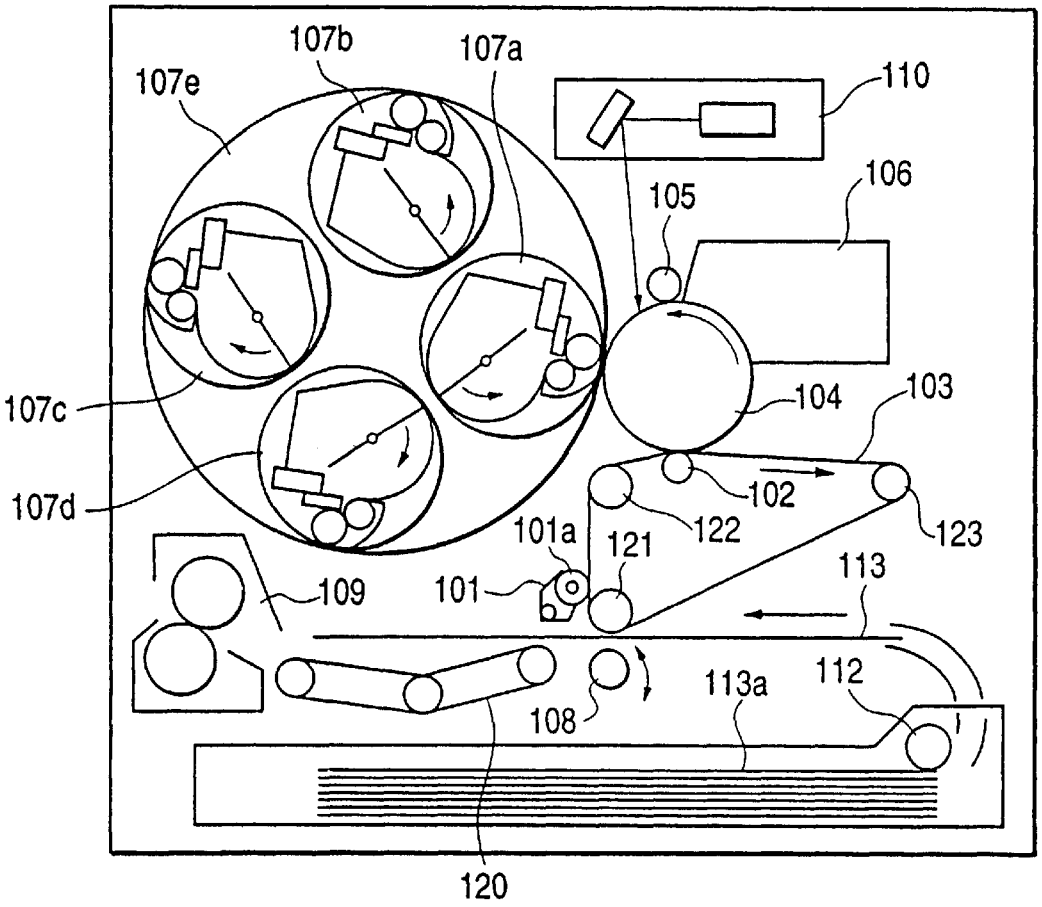
FIG. 9 PRIOR ART
FIG. 9 is a constructural view of a conventional color image forming apparatus.
Figure 10:
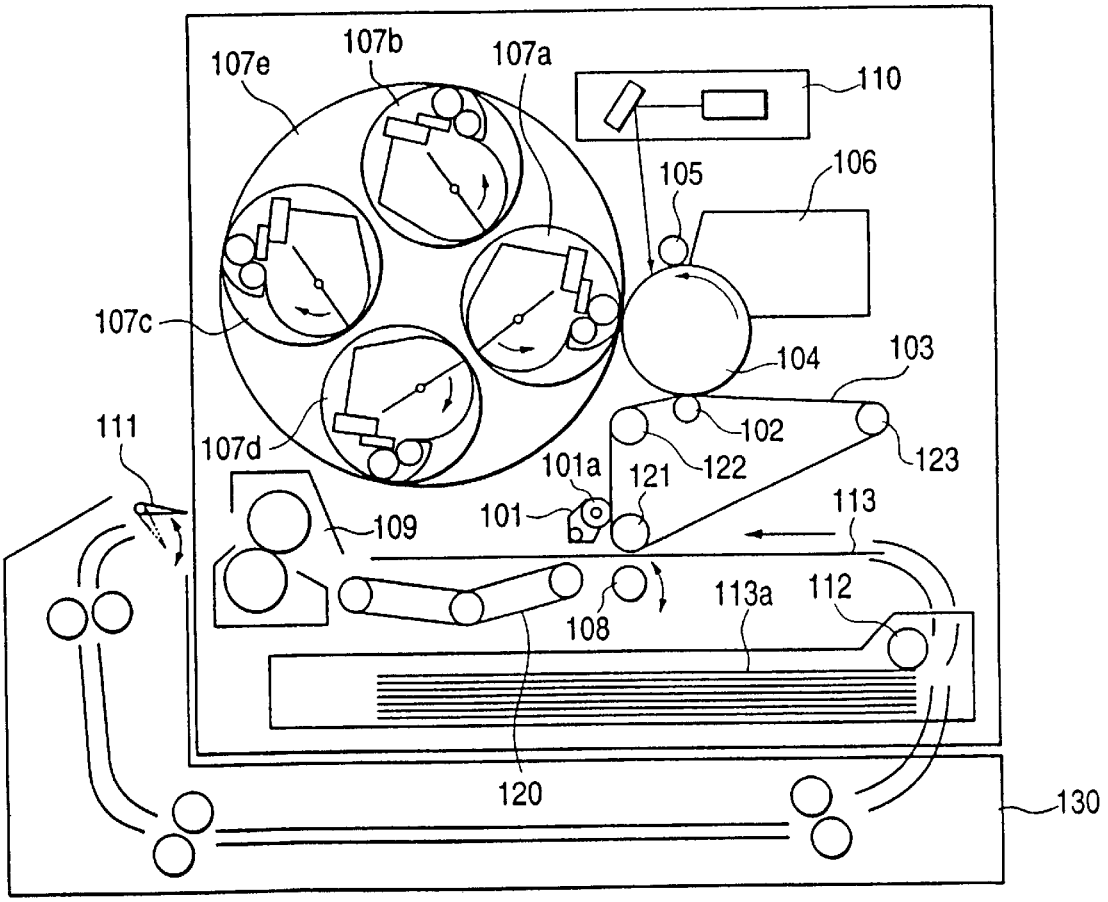
FIG. 10 PRIOR ART
FIG. 10 is a view showing a color image forming apparatus obtained by adding a sheet re-feeding device to the color image forming apparatus of FIG. 9.

An image forming apparatus shown in FIG. 1 has substantially the same construction as that of the image forming apparatus described in connection with FIGS. 9 and 10. Explaining the image forming process again, first of all, a photosensitive drum (image bearing member) 4 is rotated by driving means (not shown) in a direction shown by the arrow and is uniformly charged by a primary charger 5. Then, a laser beam corresponding to a magenta image pattern is illuminated onto the photosensitive drum 4 from an exposure device 10 to form a latent image on the photosensitive drum 4. When the photosensitive drum 4 is further rotated in the direction shown by the arrow, among developing devices 7*a*, 7*b*, 7*c*, 7*d* supported by a rotary supporting member 7*e*, a magenta developing device 7*a* containing magenta toner is rotated to be opposed to the photosensitive drum 4, so that the latent image is visualized by the magenta developing device 7*a* as a toner image.

An intermediate transfer belt (intermediate transfer member) 3 is passed over on three rollers 21, 22 (driving roller), 23 and is rotated at a speed substantially the same as that of the photosensitive drum 4 in a direction shown by the arrow. By impressing primary transfer bias to a primary transfer roller 2, the toner image formed on the photosensitive drum 4 is primary-transferred onto an outer peripheral surface of the intermediate transfer belt 3.

By repeating the above-mentioned process with respect to a cyan color, an yellow color and a black color by using the developing devices 7*b*, 7*c*, 7*d*, respectively, plural color toner images are formed on the intermediate transfer belt 3.

Then, a transfer material 13 is fed from a transfer material cassette 13*a* by a pick-up roller 12 at a predetermined timing. At the same time, secondary transfer bias is impressed to a secondary transfer roller 8, with the result that the toner images on the intermediate transfer belt 3 are transferred onto the transfer material 13 collectively. Then, the transfer material 13 is conveyed, by a conveying belt 20, to a fixing device 9, where the toner images are fused and fixed, thereby obtaining a color image.

After the secondary transfer, residual toner remaining on the intermediate transfer belt 3 is charged with opposite polarity by a charging device 1*a* as an intermediate transfer belt cleaning device 1, with the result that the residual toner is counter-transferred onto the photosensitive drum 4, thereby cleaning or removing the residual toner. On the other hand, residual toner after primary transfer and counter-transfer toner on the photosensitive drum 4 are removed by a photosensitive drum cleaning device 6.

Now, the cleaning of the intermediate transfer belt will be fully described.

Residual toner after secondary transfer is subjected to a strong electric field having polarity opposite to that of the toner when the toner is transferred from the intermediate transfer belt 3 to the transfer material 13, with the result that the residual toner may remain on the intermediate transfer belt 3 in a condition that the residual toner has been charged with polarity (positive polarity in this case) opposite to normal charging polarity (negative polarity in this case) of the toner. However, all toners cannot be reversed to the positive polarity, but there are toners partially neutralized not to have charges and/or toners remaining in negative polarity.

Thus, the charging device 1*a* is disposed at a downstream side of a secondary transfer position, i.e., immediately behind the secondary transfer position in a moving direction of the intermediate transfer belt 3 so that bias obtained by superposing an AC component with a DC component is impressed as a intermediate transfer belt cleaning bias by the charging device 1*a*.

The residual toner after secondary transfer is reciprocally moved by the AC component repeatedly so that the toner is charged more uniformly with positive polarity.

The uniformly and positively charged residual toner after secondary transfer is counter-transferred onto the photosensitive drum 4 at a primary transfer nip portion and then is collected by the cleaning device 6 for the photosensitive drum 4.

In a print operation in which a plurality of transfer materials are continuously printed, the charges of the oppositely charged residual toner after secondary transfer on the intermediate transfer belt 3 and the charges of the normal toner (to be primary-transferred) on the photosensitive drum 4 do not cancel each other by short time contact therebetween. Thus, at the primary transfer nip portion between the photosensitive drum 4 and the intermediate transfer belt 3, when the primary transfer bias is impressed, the residual toner after secondary transfer and the toner on the photosensitive drum 4 can be substantially simultaneously transferred onto the photosensitive drum 4 and the intermediate transfer belt 3, respectively. Accordingly, since the residual toner after secondary transfer is not transferred onto the transfer material 13 in the next print, a proper image can be outputted.

When the above-mentioned intermediate transfer belt cleaning device 1 is used, a waste toner container for collecting the residual toner on the intermediate transfer belt 3 can also serve as the photosensitive drum cleaning device 6 so that the apparatus can be made compact and a maintenance ability can be improved.

In the color image forming apparatus according to the illustrated embodiment, an automatic both-side printing function is added. As shown in FIG. 1, the automatic both-side printing function is realized by optionally adding a both-side unit 30 to the image forming apparatus externally or internally.

In the image forming apparatus having the automatic both-side printing function, there is provided selecting means 11 for selecting between a conveying path for discharging a sheet and a conveying path communicating with the both-side unit 30, in dependence upon whether the transfer material 13 discharged from the fixing device 9 relates to a first side print or a second side print. Further, the transfer material 13 conveyed to the both-side unit 30 by the selecting means 11 remains within the both-side unit 30 until an image to be printed on the second-side print is prepared on the photosensitive drum 4, and is re-fed in sync with a second-side image formation.

Several (1 to 3) transfer materials 13 can be stocked within the both-side unit 30 and the transfer material 13 is re-fed in response to a signal from control means (not shown) capable of judging a property of the image (whether a first-side image or a second-side image).

Figure 1:
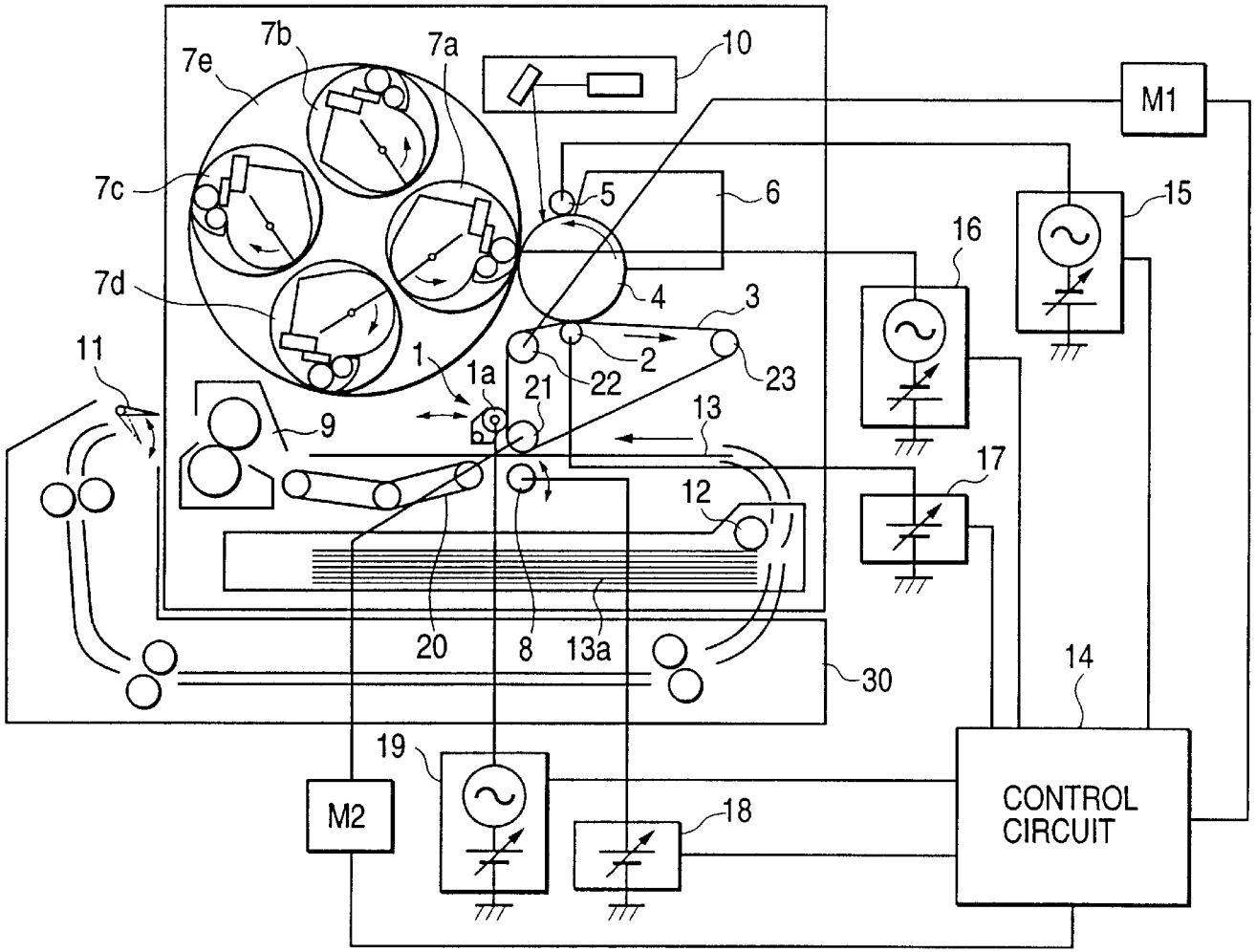
FIG. 1 is an entire constructural view of a color image forming apparatus according to a first embodiment of the present invention.

In the illustrated embodiment, as shown in FIG. 1, a primary charge bias power source 15 is connected to the primary charger (roller) 5, a developing bias power source 16 is connected to the developing devices 7*a*, 7*b*, 7*c*, 7*d*, a primary transfer bias power source 17 is connected to the primary transfer roller 2, a secondary transfer bias power source 18 is connected to the secondary transfer roller 8, and an intermediate transfer belt cleaning bias power source 19 is connected to the charging device (charging means) 1*a* of the intermediate transfer belt cleaning device 1. Outputs of the power sources can be changed in response to a signal from a control circuit 14, respectively. Incidentally, the bias power sources 15 to 19 each comprises a high-voltage power supply.

Figure 2A:
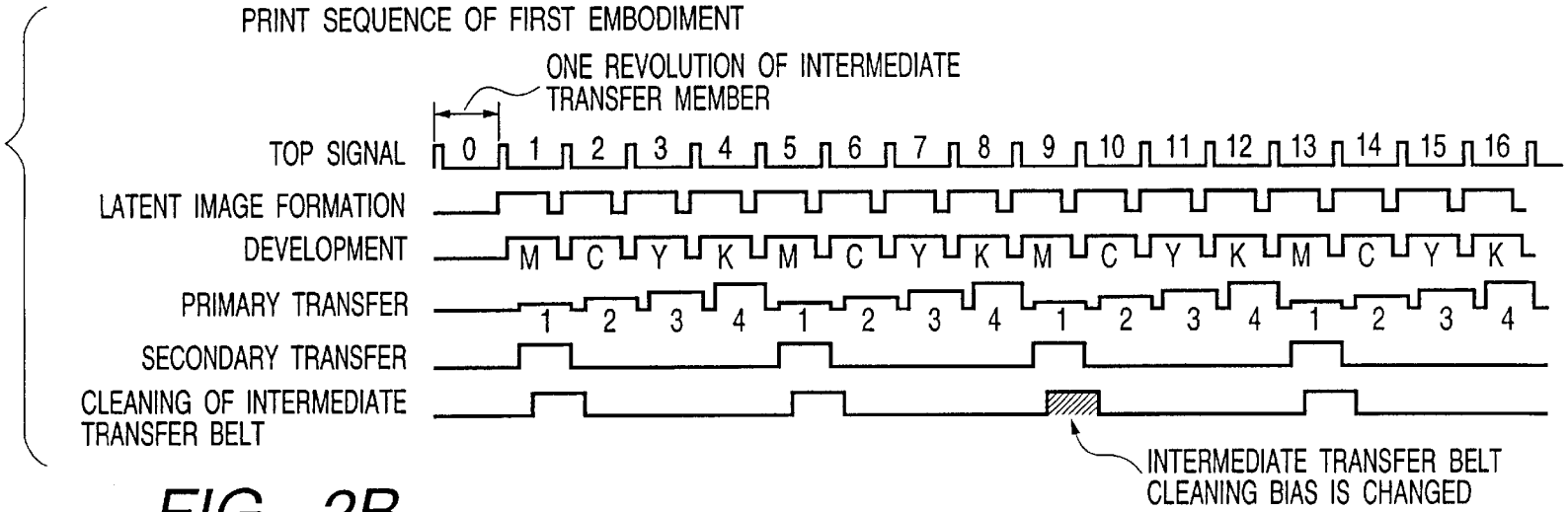
FIG. 2A is a view showing a print sequence in the first embodiment.
Figure 2B:
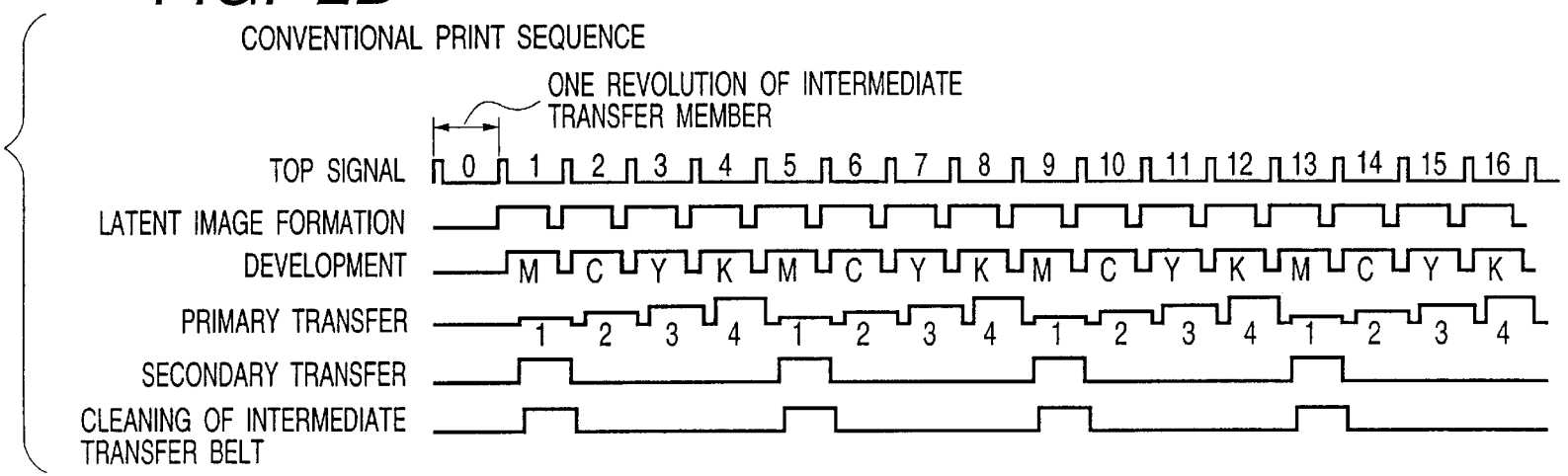
FIG. 2B is a view showing a conventional print sequence.

FIGS. 2A and 2B show a print sequence according to the illustrated embodiment and a conventional sequence, respectively, when the automatic both-side printing is performed in the color image forming apparatus. These Figures show the print sequences when full-color images are alternately printed on the first and the second sides of the transfer material. In FIG. 2A, at a hatched area (i.e., upon cleaning the intermediate transfer member after transferring of the image onto the second side), the intermediate transfer belt cleaning bias to the charging device 1*a* is changed.

Figure 3:
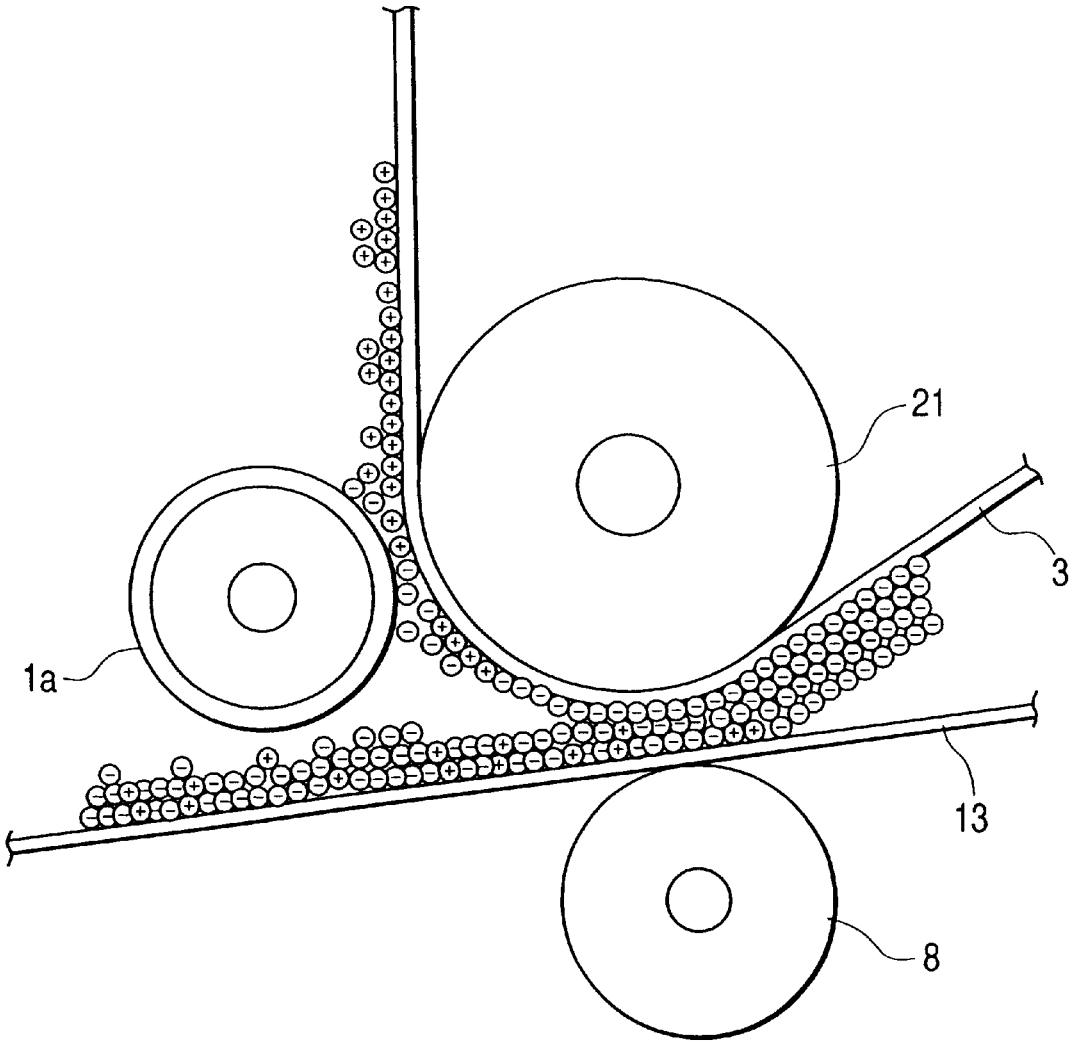
FIG. 3 is a conceptional view showing a charged state of residual toner after secondary transfer in the first embodiment.
Figures 4A, 4B:
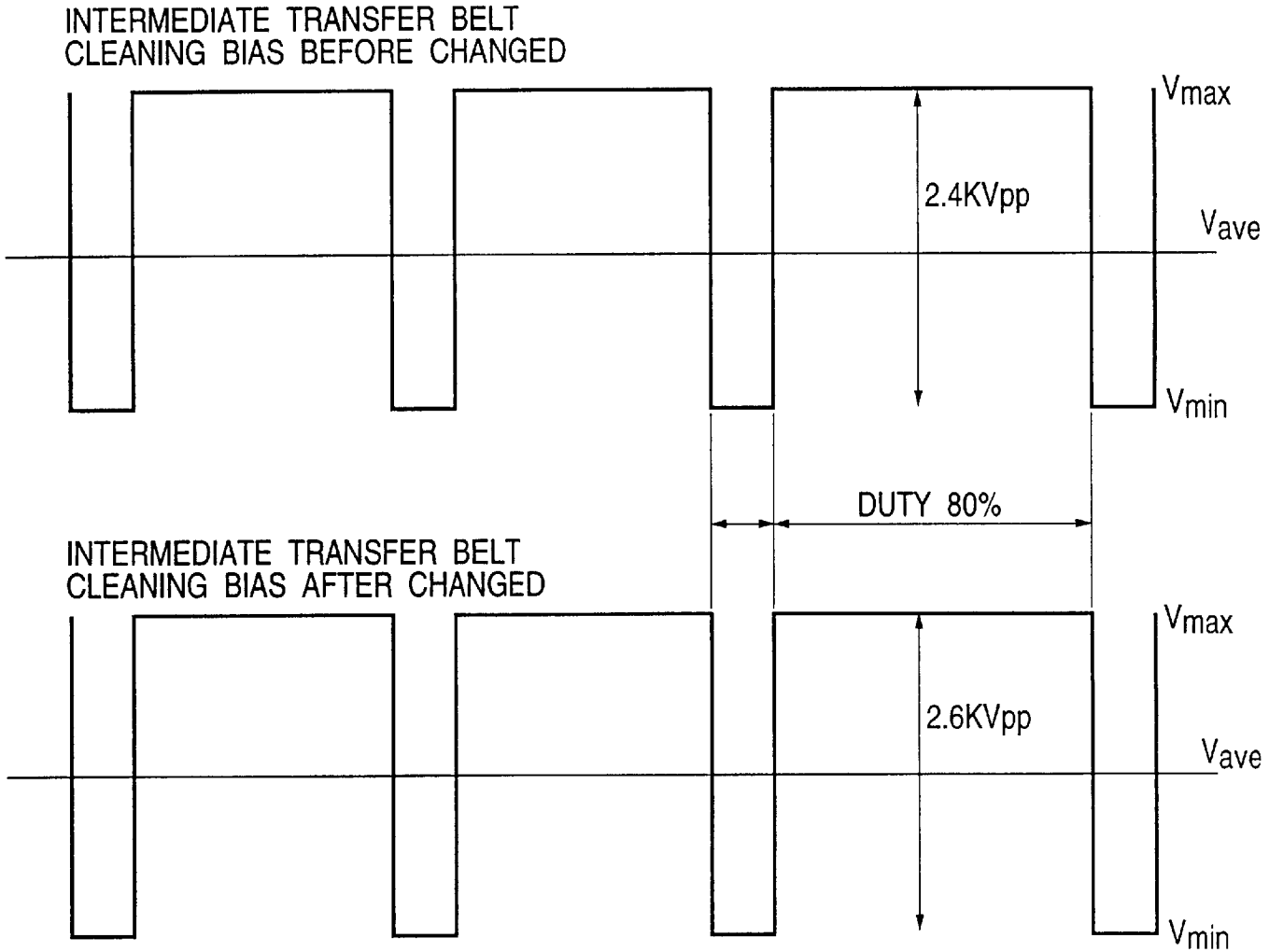
FIGS. 4A and 4B are waveform views showing intermediate transfer belt cleaning bias before changed and intermediate transfer belt cleaning bias after changed, respectively, in the first embodiment.

Now, the intermediate transfer belt cleaning bias and its charging mechanism will be described with reference to FIG. 3 and FIGS. 4A and 4B. FIG. 3 is a conceptional view showing a charged state of the residual toner after secondary transfer in the nip between the charging device 1*a* and the intermediate transfer belt 3. FIGS. 4A and 4B are views showing waveforms of the intermediate transfer belt cleaning bias before changed and after changed, respectively.

The residual toner after secondary transfer includes both positive polarity and negative polarity before the residual toner enters into the charging device 1*a*. In this state, there is the tendency that the normal counter-transferring is not effected at the primary transfer position. The residual toner after secondary transfer in this state is charged by the charging device 1*a*. However, if charging of only positive polarity is effected to the toner, only the polarity of the surface layer of the residual toner after secondary transfer is made uniform, but the polarity of the bottom layer of the residual toner after secondary transfer cannot be made uniform.

Thus, an alternate electric field is generated in the nip between the charging device 1*a* and the intermediate transfer belt 3 by using an AC bias superposed with a DC bias or an AC bias in which the duty ratio is deflected toward the positive polarity side (i.e., toward the side of polarity opposite to the normal polarity of the toner) as shown in FIGS. 4A and 4B, so that, by charging the toner layer in the vicinity of the nip portion to the positive polarity in total while vibrating the toner, even the polarity of the toner in the bottom layer can be made uniform.

Accordingly, as shown in FIGS. 4A and 4B, by increasing the peak-to-peak voltage Vpp of the AC bias to increase the vibration of the toner layer in the nip portion or by increasing a component of the positive polarity of the superposed bias or bias having the deflected duty ratio, the residual toner is charged toward the positive polarity more uniformly.

However, if the peak-to-peak voltage Vpp of the AC bias is excessively increased to strongly charging the toner with positive polarity or if the positive polarity component is too increased, the discharging electric current is also increased which increases damage of the intermediate transfer belt, with the result that the resistance of the intermediate transfer belt 3 may be deteriorated and/or cracks may be generated in the surface of the intermediate transfer belt 3, thereby shortening the service life of the intermediate transfer belt 3.

Accordingly, a condition for satisfying the service life and the cleaning ability of the intermediate transfer belt is that the cleaning bias on the secondary transferring of the second-side in which an amount of residual toner after secondary transfer is great and an amount of toner having negative polarity is great is changed in comparison with the cleaning bias in the first-side printing.

An example for changing the intermediate transfer belt cleaning bias used in the illustrated embodiment is shown in FIGS. 4A and 4B. When an AC bias having a frequency of 3 kHz, 2.4 kVpp, +Duty of 80%, DC Offset of +720 to +920 V is applied regarding the first-side (FIG. 4A), after the secondary transferring of the second-side, the bias is changed to an AC bias having a frequency of 3 kHz, 2.6 kVpp, +Duty of 80%, DC Offset of +780 to +980 V (FIG. 4B).

Here, in the illustrated embodiment, a case where the bias is deflected toward the polarity (plus side, in the illustrated embodiment) opposite to the normal polarity of the toner is defined as a case where the duty ratio is greater than 50%.

When such a waveform is used, by the charging device 1*a,* the surface of the intermediate transfer belt 3 is converged to an intermediate potential Vave between peaks (Vmax−Vmin) of the AC waveform. That is to say, when the above-mentioned waveform is used, immediately after the surface of the intermediate transfer belt 3 is passed through the charging device 1*a,* the surface is converged to about 0 through +200 V. Accordingly, in FIGS. 4A and 4B, the surface of the intermediate transfer belt is substantially converged to a straight line Vave.

In the illustrated embodiment, while an example that the peak-to-peak voltage Vpp of the AC bias is changed was explained, as mentioned above, so long as the residual toner after secondary transfer is uniformly charged, only the duty ratio or only the DC superposing component may be changed.

Further, even when the frequency component of the AC bias is changed, the reciprocal movement in the toner layer can be made more active. Therefore, the changing of the frequency is one of effective means.

[Second Embodiment]

Next, a second embodiment of the present invention will be explained with reference to FIGS. 5A, 5B, 6, 7A and 7B.

With the arrangement described in connection with the first embodiment, the intermediate transfer belt cleaning failure after the second-side print can be reduced. However, as can be understood from the print sequence shown in FIG. 2A, there is a case where a next image is formed when the intermediate transfer belt cleaning bias is being changed. Thus, in dependence upon the kind of the intermediate transfer member, under a low temperature and low humidity environment, the cleaning effect may not be achieved for the following reasons.

Figure 5A:
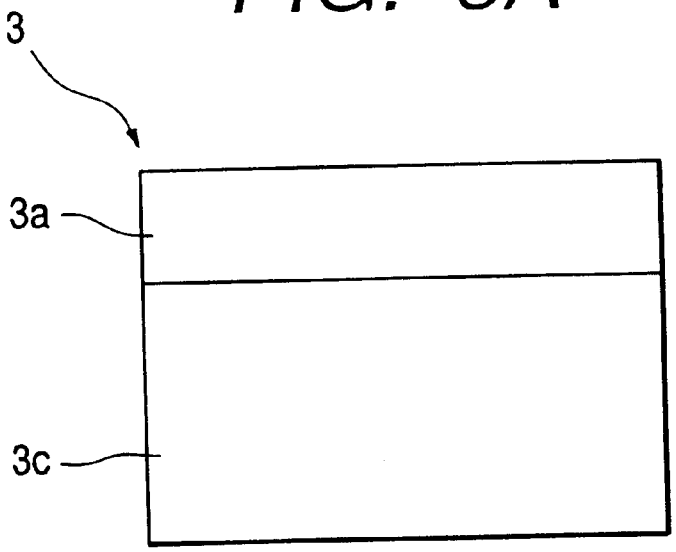
FIGS. 5A and 5B are constructual views showing two-layer structure and three-layer structure of an intermediate transfer belt according to a second embodiment of the present invention.
Figure 5B:
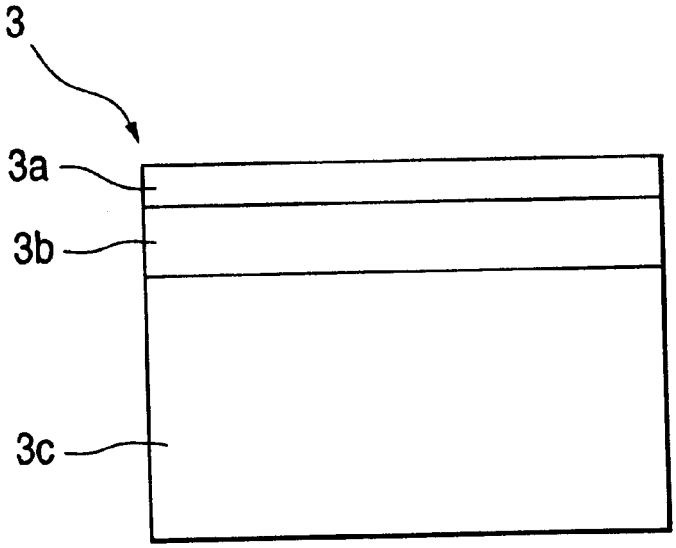

Although various structures of the intermediate transfer belt have been proposed, as shown in FIGS. 5A and 5B, there has been prevalently used a belt 3 which is constituted by two layers (FIG. 5A) or three layers (FIG. 5B) and in which a surface layer 3*a* or an intermediate layer 3*b* (having a thickness of about 5 to 50 $\mu$m) is made of material having a resistance value of $1\times10^{10}$ through $1\times10^{16}$ Ωcm and a base layer 3*c* is made of material having a resistance value of $1\times10^{3}$ through $1\times10^{8}$ Ωcm. By using such an arrangement, the superposed toner images can be prevented from being scattered, thereby improving image quality.

Regarding the intermediate transfer belt 3 having the above-mentioned arrangement, the charging device 1*a* of the intermediate transfer member cleaning device serves to make the polarity of the residual toner after secondary transfer uniform and also acts to initialize the surface potential of the intermediate transfer belt 3 charged with the positive polarity by the secondary transfer bias. Accordingly, the intermediate transfer belt cleaning bias must satisfy the uniform toner charging ability and the electricity removing ability for removing electricity from the surface of the intermediate transfer belt.

However, the method described in connection with the first embodiment is sufficient to make the charging polarity of the residual toner after secondary transfer uniform but may be excessive for removing charges having positive polarity added during the secondary transferring and for converging a potential of the surface of the intermediate transfer belt to the predetermined potential. Further, since the secondary transfer bias for the second-side must be greater than that for the first-side and since partial unevenness of electrostatic capacity is generated by presence/absence of the first-side toner image, the intermediate transfer belt is partially subjected to more positive charges than those in the first-side.

Accordingly, the surface potential of the intermediate transfer belt 3 passed through the intermediate transfer belt cleaning device 1 after the second-side print is slightly deflected toward the positive polarity in comparison with the surface potential of the intermediate transfer belt 3 passed through the intermediate transfer belt cleaning device 1 after the first-side print.

Figure 6:
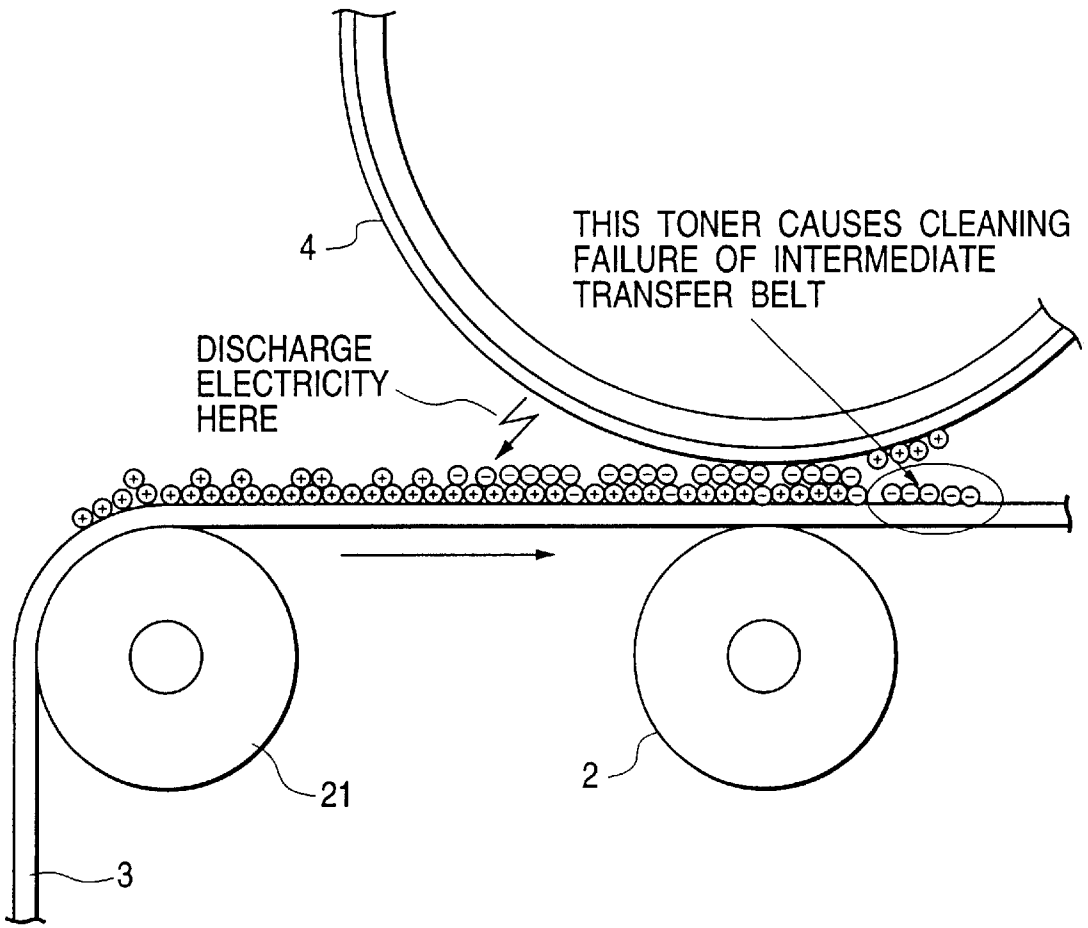
FIG. 6 is an explanatory view showing an abnormal electric discharge generated between a surface of a photosensitive drum and a surface of an intermediate transfer belt immediately before residual toner after secondary transfer enters into a primary transfer position.

In almost all cases, although such a difference in potential is reduced until the intermediate transfer belt 3 reaches to the primary transfer position, under the low temperature and low humidity environment where the surface resistance of the intermediate transfer belt 3 becomes high, the intermediate transfer belt 3 enters into the primary transfer position in a state that the surface of the intermediate transfer belt has potential greater than the desired potential by tens of or hundreds of Volts. If the residual potential is great, potential contrast between the surface of the photosensitive drum and the surface of the intermediate transfer belt becomes great, with the result that, as shown in FIG. 6, immediately before the residual toner after secondary transfer enters into the primary transfer position, an abnormal electric discharging will occur between the surface of the photosensitive drum 4 and the surface of the intermediate transfer belt 3. Due to such abnormal electric discharging, the residual toner after secondary transfer made uniform with positive polarity is charged with negative polarity again immediately before the primary transfer position, with the result that the residual toner after secondary transfer is not properly counter-transferred at the primary transfer position.

To solve this problem, in the illustrated embodiment, when the next image is formed continuously after the second-side print is completed, the potential contrast between the surface of the photosensitive drum 4 and the surface of the intermediate transfer belt 3 is controlled to a predetermined value.

More specifically, when the next image is formed continuously after the second-side print is completed, the potential contrast component to be changed is previously guessed, and the output of the primary charging bias or the primary transfer bias which determines the potential on the photosensitive drum 4 is changed in accordance with conditions.

Figure 7A:
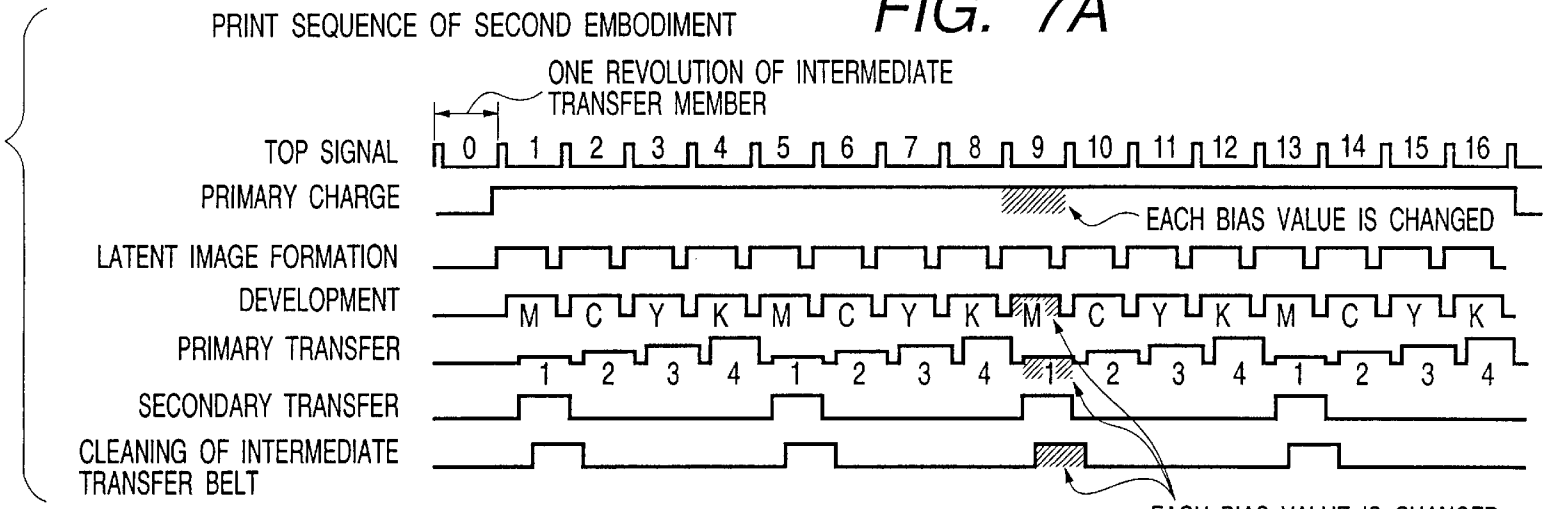
FIG. 7A is a view showing a print sequence in the second embodiment.
Figure 7B:
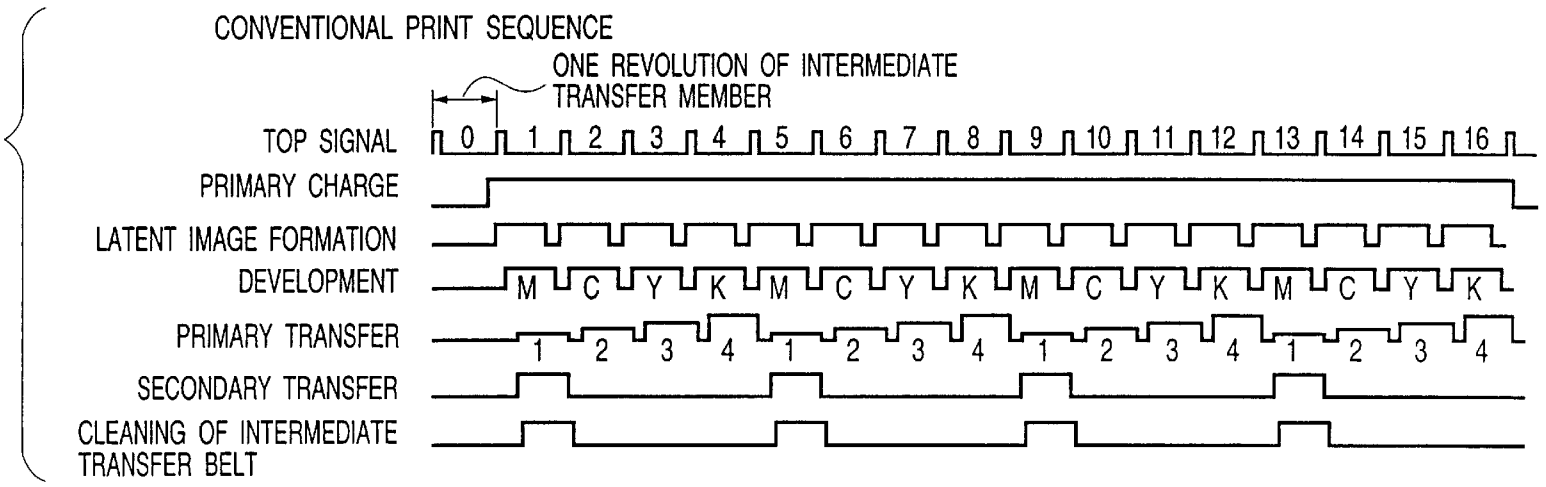
FIG. 7B is a view showing a conventional print sequence.

FIG. 7A shows a print sequence in the illustrated embodiment, and FIG. 7B shows a conventional print sequence.

In FIG. 7A, the primary charging bias and the primary transfer bias shown by the hatched areas are changed to values smaller than those in the first-side by about 5% to 25%.

For example, when −550 Volts is used as the primary charging potential (primary charging bias) in the first-side print, the bias is changed to about −480 through −500 Volts as the optimum value for the second-side print. Further, when 150 Volts is used as the primary transfer bias in the first-side print, the bias is changed to about 110 through 130 Volts as the optimum value for the second-side print.

As a result, the intermediate transfer member cleaning failure caused due to the abnormal electric discharging under the low temperature and low humidity environment can be reduced.

Further, in the illustrated embodiment, although the good intermediate transfer belt cleaning can be performed under the low temperature and low humidity environment, when the primary charging potential (primary charging bias) is changed, developing contrast between the bias and the developing bias impressed to the developing devices is also changed, with the result that, since back contrast becomes small, in a developing device in which toner is deteriorated due to long term use, the toner is scattered onto the non-image portion, thereby generating developer fog.

In order to avoid such a phenomenon, when the primary charging bias is changed to change the primary charging potential, as shown in FIG. 7A, by also changing the developing bias to the developing device 7*a*, occurrence of such a phenomenon can be prevented.

In order to avoid such a phenomenon, when the primary charging potential (the primary charging bias) is changed, the problem is solved by also changing the developing bias to the developing device 7*a*.

In case of a process cartridge in which the photosensitive drum (electrophotographic photosensitive member) 4 and the developing device 7*a* are integrally incorporated, since deterioration of toner and change in capacity of the photosensitive drum 4 can easily be guessed, the above-mentioned countermeasure is effective.

[Third Embodiment]

Next, a third embodiment of the present invention will be explained with reference to FIGS. 8A and 8B.

In order to further improve the secondary transferring ability in the second-side print, when a method in which a peripheral speed of the secondary transfer roller 8 during the secondary transferring in the second-side print is differentiated from that in the first-side print is used, in the secondary transferring in the second-side print, since the load acting on the intermediate transfer belt 3 differs from that in the first-side print, the conveying speed of the intermediate transfer belt 3 is changed, thereby worsening registration of the next image. To avoid this, there has been proposed a both-side printing method in which the next image formation is not performed in the primary transfer position immediately after the secondary transfer in the second-side print is completed, and, after the intermediate transfer belt is idly rotated by one revolution, the next image formation is performed.

In consideration of the above, according to the third embodiment, in the both-side printing method in which the next image formation is not performed in the primary transfer position immediately after the secondary transfer in the second-side print is completed, and, after the intermediate transfer belt is idly rotated by one revolution, the next image formation is performed, the intermediate transfer belt cleaning bias is also impressed during the idle rotation. In this way, the residual toner after secondary transfer is subjected to the intermediate transfer belt cleaning by two times in the second-side print.

Incidentally, in the illustrated embodiment, there are independently provided a first drive system adapted to drive the intermediate transfer belt 3 and including rollers 21, 22, 23 and a drive source M1, and a second drive system adapted to drive the transfer roller 8 and including a drive source M2.

Further, in order to permit compatibility of the cleaning ability with the high image quality, the intermediate transfer belt cleaning bias, primary charging bias and primary transfer bias immediately after the secondary transfer in the second-side print is completed are changed to a bias value suitable for the cleaning, and, the intermediate transfer belt cleaning bias, primary charging bias and primary transfer bias during the idle rotation (i.e., immediately before the next image is primary-transferred) are changed to the same values as those in the first-side print.

For example, by changing DC offset value described in connection with the first embodiment, the intermediate transfer belt cleaning bias having a waveform in which Vave becomes +200 Volts is used immediately after the secondary transferring, and, in the idle rotation, the intermediate transfer belt cleaning bias having a waveform in which Vave becomes +100 Volts is used. Further, in this case, when +110 Volts and +150 Volts are used in the primary transferring, respectively, it was found that a good image can be obtained.

Figure 8A:
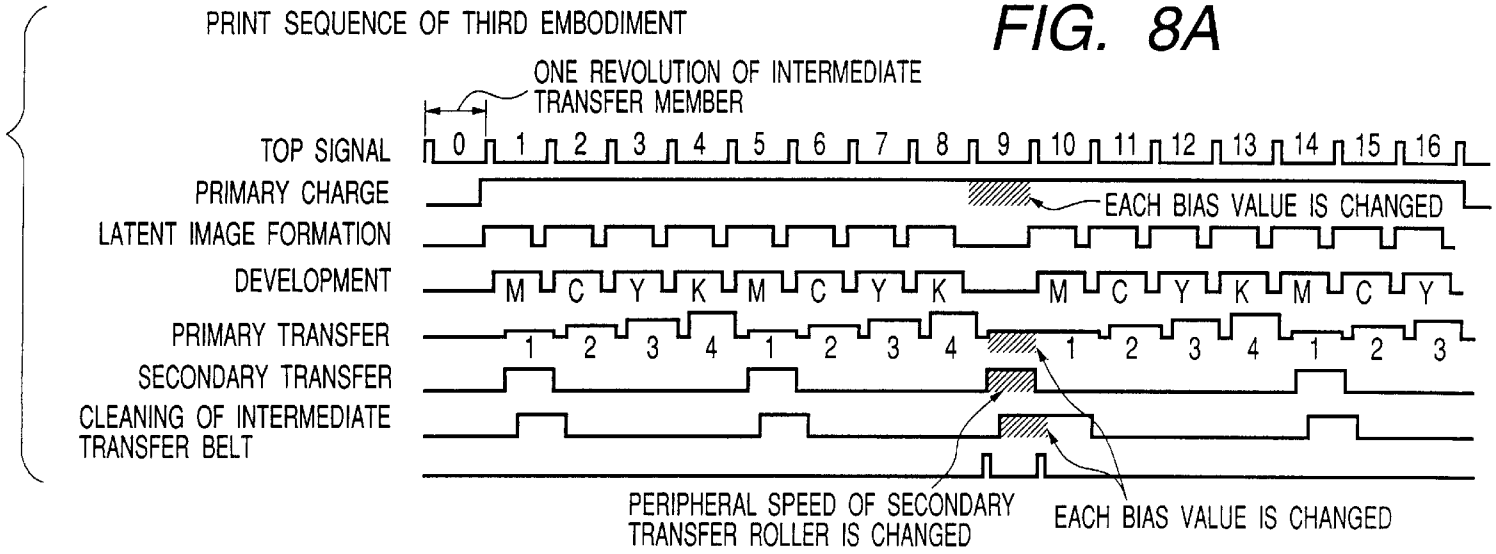
FIG. 8A is a view showing a print sequence in a third embodiment of the present invention.
Figure 8B:
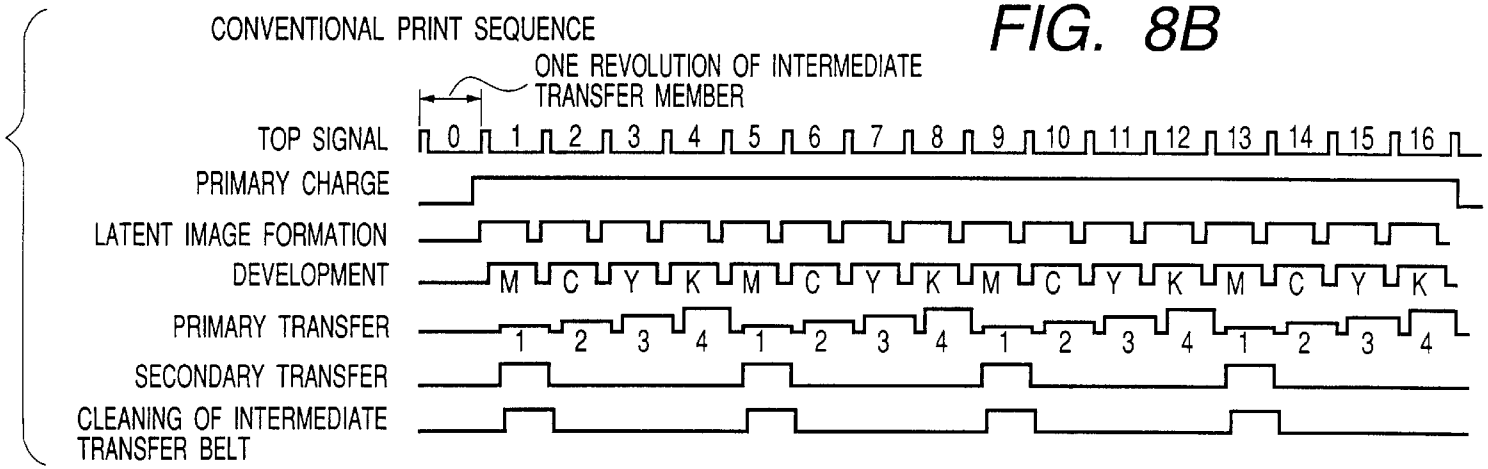
FIG. 8B is a view showing a conventional print sequence.

FIG. 8A shows a print sequence of the color image forming apparatus according to the illustrated embodiment. In this sequence, changing or alteration of the primary charging bias, primary transfer bias, intermediate transfer belt cleaning bias and peripheral speed of the secondary transfer roller are shown by the hatched areas in FIG. 8A. Further, changed values of various biases are the same as those in the above-mentioned embodiments.

As mentioned above, in the illustrated embodiment, by changing the difference in peripheral speed between the intermediate transfer belt 3 and the transfer roller 8 in the second-side printing, the amount of the residual toner after secondary transfer which causes the cleaning failure is reduced, and, further, by utilizing the idle rotation time of the intermediate transfer belt 3 effectively, inconvenience due to change in environment can be eliminated, so that the good intermediate transfer belt cleaning can be effected without developer fog and the like.

The present invention is not limited to the above-mentioned first to third embodiments, but various alterations can be made within the scope of the invention (so long as the same technical effects can be achieved). For example, the present invention can also be applied to an image forming apparatus in which a plurality of photosensitive drums are provided, and plural color toner images formed on the respective photosensitive drums are sequentially transferred onto an intermediate transfer belt on top of each other and thereafter the plural color toner images on the intermediate transfer belt are transferred onto a transfer material collectively.

What is claimed is:

1. An image forming apparatus comprising:

an intermediate transfer member;

image forming means for forming a toner image on said intermediate transfer member;

charging means for charging residual toner remaining on said intermediate transfer member after the toner image formed by said image forming means on said intermediate transfer member is electrostatically transferred onto a transfer material, wherein the residual toner charged by said charging means on said intermediate transfer member is electrostatically transferred onto said image forming means, and wherein, after the toner image is transferred from said intermediate transfer member to a first side of the transfer material, a toner image can be transferred from said intermediate transfer member to a second side of the transfer material opposite to the first side; and control means for controlling voltage to be applied to said charging means in dependence upon whether a time after the toner image is transferred from said intermediate transfer member to the first side of the transfer material or a time after the toner image is transferred from said intermediate transfer member to the second side of the transfer material.

2. An image forming apparatus according to claim 1, wherein, when the residual toner is charged, DC voltage is applied to said charging means.

3. An image forming apparatus according to claim 2, wherein said control means controls the DC voltage to be applied to said charging means.

4. An image forming apparatus according to claim 3, wherein the DC voltage applied to said charging means after the toner image is transferred from said intermediate transfer member to the second side of the transfer material is greater than the DC voltage applied to said charging means after the toner image is transferred from said intermediate transfer member to the first side of the transfer material.

5. An image forming apparatus according to any one of claims 1 to 4, wherein, when the residual toner is charged, AC voltage is applied to said charging means.

6. An image forming apparatus according to claim 5, wherein said control means controls the AC voltage to be applied to said charging means.

7. An image forming apparatus according to claim 6, wherein said control means controls peak-to-peak voltage of the AC voltage.

8. An image forming apparatus according to claim 7, wherein the peak-to-peak voltage of the AC voltage applied to said charging means after the toner image is transferred from said intermediate transfer member to the second side of the transfer material is greater than the peak-to-peak voltage of the AC voltage applied to said charging means after the toner image is transferred from said intermediate transfer member to the first side of the transfer material.

9. An image forming apparatus according to claim 5, wherein said control means controls a duty ratio of the AC voltage.

10. An image forming apparatus according to claim 9, wherein the duty ratio of the AC voltage applied to said charging means after the toner image is transferred from said intermediate transfer member to the second side of the transfer material is greater than the duty ratio of the AC voltage applied to said charging means after the toner image is transferred from said intermediate transfer member to the first side of the transfer material.

11. An image forming apparatus according to claim 5, wherein said control means controls a frequency of the AC voltage.

12. An image forming apparatus according to claim 11, wherein said image forming means includes an image bearing member, plural color toner images are sequentially transferred on top of one another from said image bearing member to said intermediate transfer member, and the plural color toner images on said intermediate transfer member are transferred onto the transfer material.

13. An image forming apparatus according to claim 1, wherein said image forming means has at least one image bearing member for bearing the toner image.

14. An image forming apparatus according to claim 13, wherein the residual toner charged by said charging means on said intermediate transfer member is electrostatically transferred onto said image bearing member.

15. An image forming apparatus according to claim 14, wherein said image forming means has transfer means for transferring the toner image on said image bearing member onto said intermediate transfer member.

16. An image forming apparatus according to claim 15, wherein said charging means charges the residual toner with polarity opposite to normal charging polarity of the toner.

17. An image forming apparatus according to claim 16, wherein said transfer means transfers the residual toner charged by said charging means on said intermediate transfer member onto said image bearing member and at the same time transfers the toner image on said image bearing member onto said intermediate transfer member.

18. An image forming apparatus according to any one of claims 15 to 17, wherein said transfer means includes an electrode contacted with a side opposite to a side to which the toner image on said intermediate transfer member is transferred.

19. An image forming apparatus according to claim 18, wherein said transfer means includes a power supply for applying voltage to said electrode.

20. An image forming apparatus according to claim 1, further comprising transfer means for electrostatically transferring the toner image on said intermediate transfer member onto the transfer material.

21. An image forming apparatus according to claim 20, wherein said transfer means includes a rotatable roller for pressurizing the transfer material against said intermediate transfer member at a pressure position, when the toner image on said intermediate transfer member is being transferred onto the transfer material.

22. An image forming apparatus according to claim 21, wherein a difference between a peripheral speed of said intermediate transfer member and a peripheral speed of said roller at said pressure position when the toner image is transferred from said intermediate transfer member to the first side of the transfer material differs from that when the toner image is transferred from said intermediate transfer member to the second side of the transfer material.

23. An image forming apparatus according to claim 22, wherein an area of said intermediate transfer member on which the toner image had been borne is passed through said pressure position, after the toner image is transferred from said intermediate transfer member to the second side of the transfer material and before the toner image is formed on said intermediate transfer member by said image forming means.

24. An image forming apparatus according to claim 1, wherein said image forming means includes a plurality of image bearing members for bearing plural color toner images, respectively, and the plural color toner images are sequentially transferred on top of one another from said image bearing members to said intermediate transfer member, and the plural color toner images on said intermediate transfer member are transferred onto the transfer material.

25. An image forming apparatus comprising:

an image bearing member;

charging means for charging said image bearing member, wherein a toner image is formed on said image bearing member charged by said charging means;

an intermediate transfer member, wherein the toner image on said image bearing member is transferred onto said intermediate transfer member and the toner image on said intermediate transfer member is transferred onto a transfer material, and wherein, after the toner image is electrostatically transferred from said intermediate transfer member to a first side of the transfer material, a toner image can electrostatically be transferred from said intermediate transfer member to a second side of the transfer material opposite to the first side; and control means for controlling voltage to be applied to said charging means in dependence upon whether an area of said intermediate transfer member onto which the toner image on said image bearing member is transferred is an area of said intermediate transfer member on which the toner image had been borne in order to transfer the toner image onto the first side of the transfer material or an area of said intermediate transfer member on which the toner image had been borne in order to transfer the toner image onto the second side of the transfer material when toner images are continuously transferred onto a plurality of transfer materials.

26. An image forming apparatus according to claim 25, wherein voltage applied to said charging means when the toner image on said image bearing member is transferred onto the area of said intermediate transfer member on which the toner image had been borne in order to transfer the toner image onto the second side of the transfer material is smaller than that when the toner image on said image bearing member is transferred onto the area of said intermediate transfer member on which the toner image had been borne in order to transfer the toner image onto the first side of the transfer material.

27. An image forming apparatus according to claim 25, further comprising voltage applying means for applying voltage to said intermediate transfer member in order to transfer the toner image on said image bearing member onto the said intermediate transfer member.

28. An image forming apparatus according to claim 27, wherein said control means controls the voltage to be applied to said voltage applying means in dependence upon whether said area of said intermediate transfer member onto which the toner image on said image bearing member is transferred is the area of said intermediate transfer member on which the toner image had been borne in order to transfer the toner image onto the first side of the transfer material or the area of said intermediate transfer member on which the toner image had been borne in order to transfer the toner image onto the second side of the transfer material.

29. An image forming apparatus according to claim 28, wherein the voltage applied to said intermediate transfer member by said voltage applying means when the toner image on said image bearing member is transferred onto the area of said intermediate transfer member on which the toner image had been borne in order to transfer the toner image onto the second side of the transfer material is smaller than that when the toner image on said image bearing member is transferred onto the area of said intermediate transfer member on which the toner image had been borne in order to transfer the toner image onto the first side of the transfer material.

30. An image forming apparatus according to claim 25, further comprising developing means for forming the toner image on said image bearing member charged by said charging means.

31. An image forming apparatus according to claim 30, wherein said control means controls voltage to be applied to said developing means, in accordance with the voltage applied to said charging means.

32. An image forming apparatus according to any one of claims 25 to 31, further comprising residual toner charging means for charging residual toner remaining on said intermediate transfer member after the toner image is electrostatically transferred from said intermediate transfer member to the transfer material.

33. An image forming apparatus according to claim 32, wherein the residual toner charged by said residual toner charging means is electrostatically transferred onto said image bearing member.

34. An image forming apparatus according to claim 33, wherein said residual toner charging means charges the residual toner on said intermediate transfer member with polarity opposite to normal charging polarity of the toner.

35. An image forming apparatus according to claim 34, wherein, at the same time when the residual toner charged by said residual toner charging means on said intermediate transfer member is transferred onto said image bearing member, the toner image on said image bearing member is transferred onto said intermediate transfer member.

36. An image forming apparatus according to claim 25, wherein plural color toner images are sequentially transferred on top of one another from said image bearing member to said intermediate transfer member, and the plural color toner images on said intermediate transfer member are transferred onto the transfer material.

37. An image forming apparatus comprising:

an image bearing member for bearing a toner image;

an intermediate transfer member;

transfer means for transferring the toner image on said image bearing member to said intermediate transfer member, wherein the toner image transferred on said intermediate transfer member by said transfer means is transferred onto a transfer material, and wherein, after the toner image is transferred from said intermediate transfer member to a first side of the transfer material, a toner image can be transferred from said intermediate transfer member to a second side of the transfer material opposite to the first side; and control means for controlling voltage to be applied to said transfer means in dependence upon whether an area of said intermediate transfer member onto which the toner image on said image bearing member is transferred is an area of said intermediate transfer member on which the toner image had been borne in order to transfer the toner image onto the first side of the transfer material or an area of said intermediate transfer member on which the toner image had been borne in order to transfer the toner image onto the second side of the transfer material when toner images are continuously transferred onto a plurality of transfer materials.

38. An image forming apparatus according to claim 37, wherein voltage applied to said transfer means when the toner image on said image bearing member is transferred onto the area of said intermediate transfer member on which the toner image had been borne in order to transfer the toner image onto the second side of the transfer material is smaller than that when the toner image on said image bearing member is transferred onto the area of said intermediate transfer member on which the toner image had been borne in order to transfer the toner image onto the firs t side of the transfer material.

39. An image forming apparatus according to claim 37 or 38, further comprising residual toner charging means for charging residual toner remaining on said intermediate transfer member after the toner image is transferred from said intermediate transfer member to the transfer material.

40. An image forming apparatus according to claim 39, wherein the residual toner charged by said residual toner charging means is transferred onto said image bearing member.

41. An image forming apparatus according to claim 40, wherein said residual toner charging means charges the residual toner on said intermediate transfer member with a polarity opposite to a normal charging polarity of the toner.

42. An image forming apparatus according to claim 41, wherein, at the same time when the residual toner charged by said residual toner charging means on said intermediate transfer member is transferred onto said image bearing member, the toner image on said image bearing member is transferred onto said intermediate transfer member.

43. An image forming apparatus according to claim 37, wherein plural color toner images are sequentially transferred on top of one another from said image bearing member to said intermediate transfer member by said transfer means, and the plural color toner images on said intermediate transfer member are transferred onto the transfer material.

44. An image forming apparatus comprising:

an image bearing member for bearing a toner image;

an intermediate transfer member onto which the toner image on said image bearing member is transferred; and a transfer rotary member for transferring the toner image on said intermediate transfer member to a transfer material, said transfer rotary member nipping and conveying the transfer material in cooperation with said intermediate transfer member between said transfer rotary member and said intermediate transfer member, wherein, after the toner image is transferred from said intermediate transfer member to a first side of the transfer material, a toner image can be transferred from said intermediate transfer member to a second side of the transfer material opposite to the first side, and wherein a peripheral speed difference between said intermediate transfer member and said transfer rotary member when the toner image is transferred to said first side of the transfer material is different from a peripheral speed difference between said intermediate transfer member and said transfer rotary member when the toner image is transferred to said second side of the transfer material.

45. An image forming apparatus according to claim 44, wherein the peripheral speed difference between said intermediate transfer member and said transfer rotary member when the toner image is transferred to said second side of the transfer material is larger than the peripheral speed difference between said intermediate transfer member and said transfer rotary member when the toner image is transferred to said first side of the transfer material.

46. An image forming apparatus according to claim 45, wherein a second peripheral speed of said transfer rotary member when the toner image is transferred to said second side of the transfer material is larger than a first peripheral speed of the transfer rotary member when the toner image is transferred to said first side of the transfer material.

47. An image forming apparatus according to claim 46, wherein, in case that images are continuously formed on a plurality of transfer materials, after the toner image is transferred onto said second side of the transfer material and after said second peripheral speed of said transfer rotary member is changed to said first peripheral speed, a transfer of the toner image from said image bearing member to said intermediate transfer member is started.

48. An image forming apparatus according to claim 47, further comprising charging means for charging toner on said intermediate transfer member in a charging position before the toner on said intermediate transfer member is transferred to said image bearing member, wherein, after the toner image is transferred to said second side of the transfer material, a residual toner remaining on said intermediate transfer member is repeatedly conveyed to said charging position and repeatedly charged by said charging means.

49. An image forming apparatus according to claim 48, wherein voltage to be applied to said charging means when the residual toner remaining on said intermediate transfer member passes through said charging position for a first time is different from voltage to be applied to said charging means when the residual toner remaining on said intermediate transfer member passes through said charging means for a second time.

50. An image forming apparatus according to claim 49, wherein direct current voltage to be applied to said charging means when the residual toner remaining on said intermediate transfer member passes through said charging position for the first time is different from direct current voltage to be applied to said charging means when the residual toner remaining on said intermediate transfer member passes through said charging position for the second time.

51. An image forming apparatus according to claim 49, wherein peak-to-peak voltage of alternating current voltage to be applied to said charging means when the residual toner remaining on said intermediate transfer member passes through said charging position for the first time is different from peak-to-peak voltage of alternating current voltage to be applied to said charging means when the residual toner remaining o n said intermediate transfer member passes though said charging position for the second time.

52. An image forming apparatus according to claim 48, wherein said charging means charges the toner on said intermediate transfer member with a polarity opposite to a normal charging polarity of the toner.

53. An image forming apparatus according to claim 52, wherein, at the same time when the residual toner charged by said charging means on said intermediate transfer member is transferred onto said image bearing member, the toner image on said image bearing member is transferred onto said intermediate transfer member.

54. An image forming apparatus according to claim 44, wherein plural color toner images sequentially transferred on top of one another from said image bearing member to said intermediate transfer member are transferred onto the transfer material by said transfer rotary member.

55. An image forming apparatus according to any one of claims 44 to 54, wherein a set value of a peripheral speed of said intermediate transfer member when the toner image is transferred to said first side of the transfer material is the same as a set value of the peripheral speed of said intermediate transfer member when the toner image is transferred to said second side of the transfer material.

* * * * *

UNITED STATES PATENT AND TRADEMARK OFFICE

CERTIFICATE OF CORRECTION

PATENT NO. : 6,308,019 B1
DATED : October 23, 2001
INVENTOR(S) : Toshiaki Miyashiro et al.

It is certified that error appears in the above-identified patent and that said Letters Patent is hereby corrected as shown below:

Title page,
Item [57], ABSTRACT,
Line 3, "a" should read -- and a --; and
Line 15, "side, and" should read -- side. The image forming apparatus further includes --

Column 1,
Line 41, "an" should read -- a --.

Column 2,
Line 16, "a" should read -- an --.

Column 3,
Line 33, "affecting" should read -- effecting --; and
Line 63, close up right margin Column 4,
Line 4, "embodiment." should read -- embodiment; --;
Line 15, close up right margin;
Line 16, "sequence:" should read -- sequence; --;
Line 19, close up right margin; and
Line 60, "an" should read -- a --.

Column 5,
Line 33, "a" should read -- an -- and "transfer" should read -- transfer --.

Column 6,
Line 13, "on" should read -- in --; and
Line 33, "comprises" should read -- comprise --.

Column 7,
Line 33, "Offset" should read -- offset --; and
Line 37, "Offset" should read -- offset --.

UNITED STATES PATENT AND TRADEMARK OFFICE

CERTIFICATE OF CORRECTION

PATENT NO. : 6,308,019 B1
DATED : October 23, 2001
INVENTOR(S) : Toshiaki Miyashiro et al.

It is certified that error appears in the above-identified patent and that said Letters Patent is hereby corrected as shown below:

Column 9,
Lines 51 through 54 should be deleted.

Column 15,
Line 1, "firs t" should read -- first --.

Column 16,
Line 15, “in” should read -- in a --; and
Line 54, "o n" should read -- on --.

Signed and Sealed this

Second Day of July, 2002

*Attest:*

*Attesting Officer*

JAMES E. ROGAN
*Director of the United States Patent and Trademark Office*